United States Patent [19]

Schick et al.

[11] 4,436,528

[45] Mar. 13, 1984

[54] AQUEOUS SLURRIES OF CARBONACEOUS MATERIALS

[75] Inventors: Martin J. Schick, New York, N.Y.; Kathy A. Knitter, Newark, Calif.

[73] Assignee: Diamond Shamrock Chemicals Company, Dallas, Tex.

[21] Appl. No.: 419,618

[22] Filed: Sep. 17, 1982

[51] Int. Cl.[3] ..... C10L 1/32

[52] U.S. Cl. ..... 44/51; 44/62; 44/77; 406/47; 406/49; 406/197; 252/353; 252/355

[58] Field of Search ..... 44/51, 62, 77; 406/197, 406/47, 49; 252/353, 355

[56] References Cited

U.S. PATENT DOCUMENTS

| | | | |
|---|---|---|---|
| 4,195,975 | 4/1980 | Hamuro et al. | 44/51 |
| 4,242,098 | 12/1980 | Braun et al. | 44/51 |
| 4,282,006 | 8/1981 | Funk | 44/51 |
| 4,330,301 | 5/1982 | Yamamura et al. | 44/51 |

FOREIGN PATENT DOCUMENTS

| | | | |
|---|---|---|---|
| 378383 | 8/1932 | United Kingdom | 252/353 |

*Primary Examiner*—Charles F. Warren
*Assistant Examiner*—Margaret B. Medley
*Attorney, Agent, or Firm*—Neal T. Levin

[57] ABSTRACT

Aqueous carbonaceous slurries having reduced viscosity, a stabilized network of carbonaceous material in water and improved pumpability are obtained by having present a salt of naphthalenesulfonic acid formaldehyde condensate and at least one water soluble polymer selected from the group consisting of sodium alginate, guar gum, locust bean gum, carboxymethylhydroxypropyl guar gum, hydroxypropyl guar gum and guarpak guar gum. For example, a mixture of 96.8% by weight of ammonium naphthalenesulfonic acid formaldehyde condensate and 3.2% by weight of sodium alginate can be added to an aqueous coal slurry in an amount of 0.31% by weight of the slurry.

23 Claims, No Drawings

AQUEOUS SLURRIES OF CARBONACEOUS MATERIALS

BACKGROUND OF THE INVENTION

1. Field of the Invention

This invention relates to aqueous carbonaceous slurries and more particularly to aqueous coal slurries stabilized with water soluble polymers.

2. Description of the Prior Art

Transport is one of the major problems involved in use of particulate carbonaceous materials such as coal. One method of transport involves aqueous slurries. However, aqueous slurries of finely ground coal containing over 55 weight percent solids are difficult to pump with slurry pumps. This is because as the solids level is increased above 50 weight percent, water and solids tend to separate causing coal particles to build up in various areas in the pumping system. This dewatering of the slurry causes blockage and jamming in the pumping system.

On the other hand, decreasing the weight percent of water in aqueous coal slurries is desirable because water is a major contributor to the cost of transport and processing operations. The less water transported the greater the volume of coal that can be moved, resulting in transport efficiencies. Further, water resources are limited. Also, during burning of coal, a significant amount of heat is required to vaporize the water. As the weight percent of water decreases, the efficiency of the coal burning process increases. Hence, use of higher weight percent solids aqueous carbonaceous slurries than were heretofore feasible would be of great importance.

U.S. Pat. No. 4,242,098—Braun et al.—Dec. 30, 1980, describes addition of particular water soluble polymers, viz., poly (ethylene oxide, partially hydrolyzed poly (acrylamide), hydroxyethyl cellulose, the quaternary nitrogen-substituted cellulose ethers, xanthan gum, hydroxypropyl guar gum and carboxymethyl hydroxypropyl guar gum, to aqueous coal slurries to permit the extrusion, pumping and transport of aqueous coal slurries having higher solids content.

U.S. Pat. No. 4,282,006—Funk, Aug. 4, 1981, describes a pipeline pumpable coal water slurry having a high content of coal particles with a minimum of void spaces and a maximum of particles surface area to enhance dispersing effects generated by electrolytes and/or dispersing agents added to the slurry. For dispersing agents, see Column 29, line 53 to Column 31, line 9, including condensed mononaphthalene sulfonic acid and its sodium and ammonium salts (Column 30, lines 19 and 20).

U.S. Pat. No. 4,330,301—Yamamura et al., May 18, 1982, describes dispersants for aqueous coal slurries including naphthalene sulfonic acid formaldehyde condensates and their sodium and ammonium salts. See Column 2, lines 41 to 3 and Columns 5 and 6.

SUMMARY OF THE INVENTION

Improved stabilized aqueous carbonaceous slurries having reduced viscosity, a stabilized network of coal in water and improved pumpability are obtained by having present a mixture of (1) at least one dispersant selected from the group consisting of sodium, lithium, potassium and ammonium salts of naphthalenesulfonic acid formaldehyde condensate and (2) as a stabilizer, at least one water soluble polymer selected from the group consisting of sodium alginate, guar gum, locust bean gum, carboxymethylhydroxypropyl guar gum, hydroxypropyl guar gum and guarpak guar gum, said mixture present in an amount sufficient to reduce viscosity of the slurry, stabilize the network of carbonaceous material in water and improve pumpability. In some instances reduced formation and accumulation of sediment which is not dispersed solely by agitation occurs. Copending application Ser. No. 387,176—Schick et al., filed June 10, 1982, describes aqueous coal slurries having present a mixture of (1) at least one dispersant selected from the group consisting of sodium, lithium, potassium and ammonium salts of naphthalenesulfonic acid formaldehyde condensate and (2) as a stabilizer, at least one water soluble polymer selected from the group consisting of gum karaya, mixtures of gum karaya and polyacrylamide and polysaccharide modified with polyacrylate, said mixture present in an amount sufficient to reduce viscosity of the slurry, stabilize the network of carbonaceous material in water and improve pumpability. In some instances reduced formation and accumulation of sediment which is not dispersed solely by agitation occurs.

DESCRIPTION OF THE PREFERRED EMBODIMENTS

The mixture of (1) at least one dispersant selected from the group consisting of the sodium, lithium, potassium and ammonium salts of naphthalenesulfonic acid formaldehyde condensate, the ammonium salts hereinafter referred to as ammonium condensate for convenience, and (2) aforesaid water soluble polymer is present in the slurry in amounts sufficient to reduce viscosity of the slurry, stabilize the network of carbonaceous material in water and improve pumpability. In some instances, reduced formation and accumulation of sediment which is not dispersible solely by agitation occurs. For example from about 0.01% by weight to about 10.0% by weight of the mixture, based on the total weight of the slurry, i.e., solids plus water, can be used. The relative amounts of the two components in the mixture with respect to each other are from about 60% by weight to about 99% by weight of dispersant to from about 1% by weight to about 40% by weight of water soluble polymer. The resulting slurries will generally have about 60% by weight solids and about 40% by weight water.

The dispersant and water soluble polymer are introduced into the slurry in the following manner. Both components can be introduced together as a mixture or each component can be introduced separately. Preferably, addition of the components is made to the slurry in sequence with the water soluble polymer first and the dispersant second.

The term "carbonaceous materials" as used herein encompasses solid particulate, carbonaceous fossil fuel materials which are crushed and milled to obtain finely divided particles suitable for use in pumpable water slurries. Generally, these materials are powdered or pulverized to a size where at least 80% will pass through a 200 mesh screen (U.S. Series). Useful carbonaceous materials include bituminous and anthracite coals, coke, petroleum coke, lignite, charcoal, peat, admixtures thereof and the like.

Water used in the slurry may be taken from any available source such as mine, well, river, or lake water or desalinated ocean water having a sufficiently low mineral salt content such that the electrochemistry of the bound water layer and carrier water interface can be controlled and corrosion of milling facilities, pipelines and furnaces will be minimized and controllable.

The dispersant may be prepared by reacting naphthalene with formaldehyde and sulfuric acid and neutralizing with sodium, lithium, potassium or ammonium hydroxide depending upon the desired cation. Useful processes are described in U.S. Pat. No. 2,141,569—Tucker et al.—Dec. 27, 1938; U.S. Pat. No. 3,193,575—Nebel et al.—July 6, 1965 and U.S. Pat. No. 3,277,162—Johnson—Oct. 4, 1966.

Naphthalenesulfonic acid formaldehyde condensate is a mixture of condensation products of naphthalenesulfonic acid and formaldehyde. It can be chromatographed by size exclusion chromatography through a column containing pore sizes which selectively separate molecular volumes according to size. The solvent chosen for the acid in chromatography should minimize solutepacking interaction and solute-solute interaction. The chromatogram gives a true molecular volume profile when the eluents are displayed on a detector-strip chart recorder display. The chromatogram for a sample of the sulfonic acid used in the examples is the same as that for the sodium naphthaleneformaldehyde sulfonate in U.S. Pat. No. 3,954,491—Adrian et al.—May 4, 1976, and the two anionic materials are identical. That is, the anionic materials from the sulfonic acid have the same profile as the anionic materials from the sodium naphthaleneformaldehyde sulfonate having lowest elution volumes of from about 61 to about 70% of the total elution volume and equivalent elution volumes of from about 61 to about 70% of the total elution volume. The teachings in U.S. Pat. No. 3,954,491 relating to chromatography are incorporated by reference herein. This chromatographic method was described by Dr. Harold Edelstein in a paper entitled, "Aqueous Gel Permeation Chromatograph of Some Naphthalene Sulfonic Acid Formaldehyde Condensates" presented at the Mini Symposium of the North Jersey Chromatography Group Subsection of the A.C.S. on Mar. 6, 1978 at Hoffman La Roche Auditorium, Clifton, N.J.

The water soluble polymers which are useful herein are one or more of the following:

- Sodium Alginate (Keltex®-Kelco, Division of Merck & Co., San Diego, CA)
- Guar Gum (Jaguar A-40-F-Stein, Hall and Co., New York, N.Y.)
- Locust Bean Gum P-100 (Meer Corporation, North Bergen, N.J.)
- Carboxymethylhydroxypropyl Guar Gum (Jaguar CMHP-Stein, Hall and Co., New York, N.Y.)
- Hydroxypropyl Guar Gum (Jaguar HP-11-Stein, Hall and Co., New York, N.Y.)
- Guarpak Guar Gum (Natural Guar Gum-Pak Nippon Industries, Ltd., Karachi, Pakistan)

The information given in the parentheses following each gum above identifies the sources of the water soluble polymers used in the Examples herein.

For a fuller understanding of the nature and advantages of this invention, reference may be made to the following examples. These examples are given merely to illustrate the invention and are not to be construed in a limiting sense.

EVALUATION OF DISPERSANTS FOR AQUEOUS CARBONACEOUS SLURRIES

The following procedure was utilized in the evaluation of the products of the examples in aqueous coal slurries. This is achieved by determining the ability of the products to disperse or suspend coal dust uniformly in water by measuring viscosity and examining the sediment, if formed.

Apparatus Used 8-oz. paint can
Low shear mechanical mixer with a double blade
Spatula
Stormer viscometer

Reagents Used

Water of known record hardness
Coal dust—Reference coal is Pittston Coal, 80% through 200 mesh (U.S. Series). Other types of coal and grind sizes can be substituted.
Stabilizing agent

Procedure

1. A slurry of coal dust in water is prepared as follows. Coal dust is slowly added to water under agitation by a low shear mechanical mixer with a double blade. (Do not use a "Lightnin" high speed mixer.) Sides of the container are scraped regularly while mixing. The slurry is agitated for an additional hour to ensure uniformity.
2. Into 200 gram samples of the slurries weighed out into 8 oz. paint cans, specific quantities of the water soluble polymer are weighed out, the cans closed tightly to prevent evaporation of water, allowed to sit overnight and then checked for sediment firmness with 3/16" glass rod. Subsequently, the dispersant is added and the viscosity determined according to 3 below. The sediment firmness is rechecked after 72 hours or 168 hours.
3. Visocosity of the aqueous coal slurry is determined upon 200 gram samples of the slurry in 8 oz. paint cans. Each slurry is stirred with a spatula before viscosity measurements are made with a Stormer Viscometer. Weights are adjusted in order to find a reading as close as possible to 30 seconds and the correct weight for a 30-second viscosity is determined. Readings are repeated twice after strirring each time and should not differ by more than 2 seconds. Readings are repeated until consistent and the average of two readings taken.
4. Seconds and weight are converted into krebs units which are then converted to centipoise readings.

All percents by weight in the examples are percents by weight based upon the total weight of the slurry.

In the examples, the improvement over the use of ammonium condensate alone is demonstrated. It is demonstrated in the examples that addition to the slurry of 0.05%, 0.10% or 0.20% by wt. of stabilizer, including the carboxymethylhydroxypropyl guar gum and hydroxypropyl guar gum described in U.S. Pat. No. 4,242,098—Braun et al., Dec. 30, 1980, and within the preferred water soluble polymer concentration described in this patent, increases the slurry viscosity of mixtures which also contain 0.3% by wt. dispersant. The increased viscosity is greater than the viscosity which is obtained by the dispersant alone (See Example I, Table C). However, unexpectedly, the addition to the slurry of 0.01% or 0.02% by wt. of stabilizer, including the carboxymethylhydroxypropyl guar gum and hydroxypropyl guar gum described in U.S. Pt. No. 4,242,098—Braun et al., Dec. 30, 1980, decreases the slurry viscosity to low pumpable values in mixtures which also contain 0.3% by wt. dispersant. The decreased viscosity is less than the viscosity which is obtained by the dispersant alone (See Example II, Table F). Corresponding results in mixtures with 0.6% by wt. of dispersant are selective. The invention may be also expressed as follows. At a constant low level of 0.01% and 0.02% by wt. of water soluble polymer in the slurry, the viscosity unexpectedly decreases to very low pumpable values by addition of 0.3% or 0.6% by wt. of dispersant.

Referring again to U.S. Pat. No. 4,242,098—Braun et al., Dec. 30, 1980, which describes addition of particular water soluble polymers to aqueous coal slurries including hydroxypropyl guar gum and carboxymethylhydroxypropyl guar gum, it can be seen that the present invention was most unexpected. That is, slurry viscosities where mixtures of water soluble polymer in particular amounts and dispersing agents are present are dramatically lower than the slurry viscosities where water soluble polymer in greater amounts is present alone or where mixtures of water soluble polymer in greater amounts and condensate are present.

EXAMPLE I

The effect of various stabilizers on the consistency and viscosity of a coal/water slurry containing 0.3% by wt. ammonium naphthalenesulfonic acid formaldehyde condensate is illustrated in Tables B and C. The slurry composition is given in Table A. The slurries were prepared and tested in accordance with the preparation and test procedure given above.

TABLE A

| Component | % By Wt. |
|---|---|
| Pittston Coal (80% <200 mesh U.S. Sieve Series) | 60 |
| Distilled Water | Varies |
| Ammonium Condensate | 0.30 |
| Water Soluble Polymer (Stabilizer) | 0.05, 0.10 or 0.20 |
| | 100 |

TABLE B

Effect of Various Stabilizers on Consistency of a Coal/Water Slurry Containing 0.3% by Wt. Ammonium Naphthalenesulfonic Acid Formaldehyde Condensate (Ammonium Cond.).

| | | Consistency of Slurry | |
|---|---|---|---|
| Stabilizer | Conc. of Stabilizer, (% by Wt.) | Before Addn. of Ammonium Cond. (Stabilizer Alone) | 72 Hours After Addn. of Ammonium Cond. |
| None | 0.00 | Semi-Firm | Firm |
| Sodium Alginate | 0.05 | Semi-Firm | Soft |
| | 0.10 | Semi-Firm | Soft-No Separation |
| | 0.20 | Firm | Semi-Firm |
| Guar Gum | 0.05 | Semi-Firm | Firm |
| | 0.10 | Semi-Firm | Semi-Firm |
| | 0.20 | Soft-No Separation | Soft |
| Locust Bean Gum P-100 | 0.05 | Semi-Firm | Semi-Firm |
| | 0.10 | Semi-Firm | Semi-Firm |
| | 0.20 | Soft | Soft |
| Carboxymethyl-hydroxypropyl Guar Gum | 0.05 | Semi-Firm | Firm |
| | 0.10 | Semi-Firm | Firm |
| | 0.20 | Soft-No | Soft |

TABLE B-continued

Effect of Various Stabilizers on Consistency of a Coal/Water Slurry Containing 0.3% by Wt. Ammonium Naphthalenesulfonic Acid Formaldehyde Condensate (Ammonium Cond.).

| | | Consistency of Slurry | |
|---|---|---|---|
| Stabilizer | Conc. of Stabilizer, (% by Wt.) | Before Addn. of Ammonium Cond. (Stabilizer Alone) | 72 Hours After Addn. of Ammonium Cond. |
| | | Separation | |
| Hydroxypropyl Guar Gum | 0.05 | Semi-Firm | Semi-Firm |
| | 0.10 | Semi-Firm | Firm |
| | 0.20 | Semi-Firm | Firm |
| Guarpak Guar Gum | 0.05 | Semi-Firm | Firm |
| | 0.10 | Semi-Firm | Firm |
| | 0.20 | Soft-No Separation | Soft |

TABLE C

Effect of Various Stabilizers on Viscosity of a Coal/Water Slurry Containing 0.3% by Wt. Ammonium Naphthalenesulfonic Acid Formaldehyde Condensate (Ammonium Cond.)

| Stabilizer | Conc. of Stabilizer, (% by Wt.) | Viscosity, cps. |
|---|---|---|
| None | 0.00 | 480 |
| Sodium Alginate | 0.05 | 1150 |
| | 0.10 | 2000 |
| | 0.20 | >5000 |
| Guar Gum | 0.05 | 3187 |
| | 0.10 | 2300 |
| | 0.20 | 2571 |
| Locust Bean Gum P-100 | 0.05 | >5000 |
| | 0.10 | 3000 |
| | 0.20 | 3500 |
| Carboxymethyl-hydroxypropyl Guar Gum | 0.05 | 2571 |
| | 0.10 | 1500 |
| | 0.20 | 2375 |
| Hydroxypropyl Guar Gum | 0.05 | 2375 |
| | 0.10 | 2460 |
| | 0.20 | 2150 |
| Guarpak Guar Gum | 0.05 | >5000 |
| | 0.10 | 2786 |
| | 0.20 | 3062 |

It is evident from the data of Table B that the stabilizers at concentration levels of 0.05%, 0.10% and 0.20% by wt. contributed no significant improvement to the consistency of the sediment of coal/water slurries containing 0.3% by wt. of ammonium condensate after 72 hours had elapsed from the addition of the ammonium condensate. Likewise, as illustrated in Table C, none of the stabilizers at a concentration level of 0.05%, 0.10% and 0.20% by wt. lowered the viscosity of coal/water slurries containing 0.3% by wt. of ammonium condensate. On the contrary, addition of these stabilizers in the quantities indicated greatly increases the slurry viscosity to its detriment.

EXAMPLE II

The effect of various stabilizers on the consistency and viscosity of a coal/water slurry containing 0.00%, 0.3% and 0.6% by wt. ammonium naphthalenesulfonic acid formaldehyde condensate is illustrated in Tables E and F. The slurry composition is given in Table D. The slurries were prepared and tested in accordance with the preparation and test procedure given above.

TABLE D

| Component | % By Wt. |
|---|---|
| Pittston Coal (80% <200 mesh U.S. Sieve Series) | 60 |
| Distilled Water | Varies |
| Ammonium Condensate | 0.00, 0.30 or 0.60 |
| Water Soluble Polymer (Stabilizer) | 0.01 or 0.02 |
| | 100 |

TABLE E

Effect of Various Stabilizers on Consistency of Slurry Containing 0.0%, 0.3% or 0.6% by Wt. Ammonium Naphthalenesulfonic Acid Formaldehyde Condensate (Ammonium Cond.).

| Stabilizer | Conc. of Stabilizer (% By Wt.) | Conc. of Ammonium Cond. (% By Wt.) | Consistency of Slurry: Before Addn. of Ammonium Cond. (Stabilizer Alone) | Consistency of Slurry: 168 Hours After Addn. of Ammonium Cond. |
|---|---|---|---|---|
| None | 0.00 | 0.3 | Semi-Firm | Firm |
| None | 0.00 | 0.6 | Semi-Firm | Firm |
| Sodium Alginate | 0.01 | 0.0 | Semi-Firm (Separation) | Soft |
| | 0.01 | 0.3 | Soft | Firm |
| | 0.01 | 0.6 | Soft | Firm |
| Sodium Alginate | 0.02 | 0.0 | Semi-Firm (Separation) | Semi-Firm |
| | 0.02 | 0.3 | Soft | Semi-Firm |
| | 0.02 | 0.6 | Soft | Semi-Firm |
| Guar Gum | 0.01 | 0.0 | Semi-Firm | Soft |
| | 0.01 | 0.3 | Soft | Firm |
| | 0.01 | 0.6 | Soft | Semi-Firm |
| Guar Gum | 0.02 | 0.0 | Semi-Firm | Soft |
| | 0.02 | 0.3 | Soft | Firm |
| | 0.02 | 0.6 | Soft | Firm |
| Locust Bean Gum P-100 | 0.01 | 0.0 | Semi-Firm | Soft |
| | 0.01 | 0.3 | Soft | Semi-Firm |
| | 0.01 | 0.6 | Soft | Semi-Firm |
| Locust Bean Gum P-100 | 0.02 | 0.0 | Semi-Firm | Semi-Firm |
| | 0.02 | 0.3 | Soft | Semi-Firm |
| | 0.02 | 0.6 | Soft | Semi-Firm |
| Carboxymethyl-hydroxypropyl Guar Gum | 0.01 | 0.0 | Soft | Semi-Firm |
| | 0.01 | 0.3 | Soft | Firm |
| | 0.01 | 0.6 | Soft | Semi-Firm |
| Carboxymethyl-hydroxypropyl Guar Gum | 0.02 | 0.0 | Soft | Semi-Firm |
| | 0.02 | 0.3 | Soft | Semi-Firm |
| | 0.02 | 0.6 | Semi-Firm | Semi-Firm |
| Hydroxypropyl Guar Gum | 0.01 | 0.0 | Semi-Firm | Semi-Firm |
| | 0.01 | 0.3 | Soft | Firm |
| | 0.01 | 0.6 | Soft | Firm |
| Hydroxypropyl Guar Gum | 0.02 | 0.0 | Semi-Firm | Semi-Firm |
| | 0.02 | 0.3 | Soft | Semi-Firm |
| | 0.02 | 0.6 | Semi-Firm | Semi-Firm |
| Guarpak Guar Gum | 0.01 | 0.0 | Semi-Firm | Semi-Firm |
| | 0.01 | 0.3 | Soft | Semi-Firm |
| | 0.01 | 0.6 | Soft | Semi-Firm |
| Guarpak Guar Gum | 0.01 | 0.0 | Semi-Firm | Semi-Firm |
| | 0.01 | 0.3 | Semi-Firm | Semi-Firm |
| | 0.01 | 0.6 | Semi-Firm | Semi-Firm |

TABLE F

Effect of Various Stabilizers on Viscosity of Slurry Containing 0.0%, 0.3% or 0.6% by Wt. Ammonium Naphthalenesulfonic Acid Formaldehyde Condensate (Ammonium Cond.).

| Stabilizer | Conc. of Stabilizer (% By Wt.) | Conc. of Ammonium Cond. (% By Wt.) | Viscosity, cps. |
|---|---|---|---|
| None | 0.00 | 0.3 | 700 |
| None | 0.00 | 0.6 | 480 |
| Sodium Alginate | 0.01 | 0.0 | 3,125 |
| | 0.01 | 0.3 | 220 |
| | 0.01 | 0.6 | 210 |

TABLE F-continued

Effect of Various Stabilizers on Viscosity of Slurry Containing 0.0%, 0.3% or 0.6% by Wt. Ammonium Naphthalenesulfonic Acid Formaldehyde Condensate (Ammonium Cond.).

| Stabilizer | Conc. of Stabilizer (% By Wt.) | Conc. of Ammonium Cond. (% By Wt.) | Viscosity, cps. |
|---|---|---|---|
| Sodium Alginate | 0.02 | 0.0 | 4,333 |
| | 0.02 | 0.3 | 240 |
| | 0.02 | 0.6 | 210 |
| Guar Gum | 0.01 | 0.0 | 3,062 |
| | 0.01 | 0.3 | 210 |
| | 0.01 | 0.6 | 240 |
| Guar Gum | 0.02 | 0.0 | 2,928 |
| | 0.02 | 0.3 | 220 |
| | 0.02 | 0.6 | 220 |
| Locust Bean Gum P-100 | 0.01 | 0.0 | 2,857 |
| | 0.01 | 0.3 | 260 |
| | 0 01 | 0.6 | 200 |
| Locust Bean Gum P-100 | 0.02 | 0.0 | >4,500 |
| | 0.02 | 0.3 | 460 |
| | 0.02 | 0.6 | 575 |
| Carboxymethyl-hydroxypropyl Guar Gum | 0.01 | 0.0 | 3,875 |
| | 0.01 | 0.3 | 240 |
| | 0.01 | 0.6 | 420 |
| Carboxymethyl-hydroxypropyl Guar Gum | 0.02 | 0.0 | 4,500 |
| | 0.02 | 0.3 | 380 |
| | 0.02 | 0.6 | 600 |
| Hydroxypropyl Guar Gum | 0.01 | 0.0 | 2,714 |
| | 0.01 | 0.3 | 230 |
| | 0.01 | 0.6 | 220 |
| Hydroxypropyl Guar Gum | 0.02 | 0.0 | 2,600 |
| | 0.02 | 0.3 | 240 |
| | 0.02 | 0.6 | 400 |
| Guarpak Guar Gum | 0.01 | 0.0 | 3,375 |
| | 0.01 | 0.3 | 420 |
| | 0.01 | 0.6 | 767 |
| Guarpak Guar Gum | 0.02 | 0.0 | 2,700 |
| | 0.02 | 0.3 | 875 |
| | 0.02 | 0.6 | 1,175 |

As illustrated in Table F, the viscosity of coal water slurries containing 0.01% and 0.02% by wt. stabilizer decreased dramatically on addition of 0.3% and 0.6% by wt. of ammonium condensate. Moreover, the viscosity of coal/water slurries with stabilizers such as sodium alginate, guar gum, locust bean gum, carboxymethylhydroxypropyl guar gum and hydroxypropyl guar gum at a concentration level of 0.01% by wt. in the presence of 0.3% and 0.6% by wt. of ammonium condensate were lower than the viscosity of slurries containing only 0.3% and 0.6% by wt. of ammonium condensate. The viscosity of coal/water slurries with stabilizers such as sodium alginate, guar gum, locust bean gum, carboxymethylhydroxypropyl guar gum and hydroxypropyl guar gum at a concentration of 0.02% by wt. in the presence of 0.3% and 0.6% by wt. of ammonium condensate were lower or about equal to the viscosity of slurries containing only 0.3% and 0.6% by wt. of ammonium condensate.

While the invention has been described with reference to certain specific embodiments thereof, it is understood that it is not to be so limited since alterations and changes may be made therein which are within the full intended scope of the appended claims.

What is claimed is:

1. A stabilizer composition for aqueous carbonaceous slurries comprising:

(a) at least one dispersant selected from the group consisting of the sodium, lithium, potassium and ammonium salts of naphthalenesulfonic acid formaldehyde condensate, and (b) at least one water soluble polymer selected from the group consisting of sodium alginate, guar gum, locust bean gum, carboxymethylhydroxypropyl guar gum, hydroxypropyl guar gum and guarpak guar gum.

2. The composition of claim 1 wherein said component (a) is present in an amont from about 60% by weight to about 99% by weight and said component (b) is present in an amount of about 1% by weight to about 40% by weight.

3. The composition of claim 2 wherein said component (a) is the sodium salt of naphthalenesulfonic acid formaldehyde condensate.

4. The composition of claim 2 wherein said component (a) is the ammonium salt of naphthalenesulfonic acid formaldehyde condensate.

5. The composition of claim 2 wherein said component (b) is sodium alginate.

6. The composition of claim 2 wherein said component (b) is guar gum.

7. The composition of claim 2 wherein component (b) is locust bean gum.

8. The composition of claim 2 wherein component (b) is carboxymethylhydroxypropyl guar gum.

9. The composition of claim 2 wherein said component (b) is hydroxypropyl guar gum.

10. An aqueous carbonaceous slurry having present the stabilizer composition of claim 1 in an amount sufficient to reduce viscosity of the slurry, stabilize the network of carbonaceous material in water and improve pumpability.

11. The slurry of claim 8 wherein said slurry contains coal.

12. The slurry of claim 11 wherein said stabilizer composition is present in an amount of from about 0.01% by weight to about 10.0% by weight of the slurry.

13. The slurry of claim 12 wherein said stabilizer composition is composed of component (a) present in an amount of about 60% by weight to about 99% by weight and component (b) present in an amount of about 1% by weight of about 40% by weight.

14. The slurry of claim 13 wherein said component (a) is the sodium salt of naphthalenesulfonic acid formaldehyde condensate.

15. The slurry of claim 13 wherein said component (a) is the ammonium salt of naphthalenesulfonic acid formaldehyde condensate.

16. The slurry of claim 13 wherein component (b) is sodium alginate.

17. The slurry of claim 13 wherein component (b) is guar gum.

18. The slurry of claim 13 wherein component (b) is locust bean bum.

19. The slurry of claim 13 wherein component (b) is carboxymethylhydroxypropyl guar gum.

20. The slurry of claim 13 wherein component (b) is hydroxypropyl guar gum.

21. A process for preparing stable aqueous carbonaceous slurries comprising incorporating into said slurry the composition of claim 1 in an amount sufficient to reduced water content of the slurry, stabilize the network of carbonaceous material in water and improve pumpability.

22. The process of claim 21 wherein said carbonaceous material is coal.

23. The process of claim 22 wherein said component (b) is first added to said slurry and said component (a) is thereafter added to said slurry.

* * * * *